United States Patent [19]

Johnston et al.

[11] Patent Number: 4,521,935

[45] Date of Patent: Jun. 11, 1985

[54] VACUUM SPRAY HEAD

[75] Inventors: Charles R. Johnston, Wilmington, N.C.; Gregory M. Green, Port St. Lucie, Fla.

[73] Assignee: Container Products Corp., Wilmington, N.C.

[21] Appl. No.: 527,256

[22] Filed: Aug. 29, 1983

[51] Int. Cl.[3] ..... A47L 11/34

[52] U.S. Cl. ..... 15/322

[58] Field of Search ..... 15/321, 322, 354, 314

[56] References Cited

U.S. PATENT DOCUMENTS

| | | | |
|---|---|---|---|
| 3,705,437 | 12/1972 | Rukavina et al. | 15/322 XR |
| 3,747,155 | 7/1973 | Koellisch | 15/322 |
| 3,774,262 | 11/1973 | Anthony et al. | 15/322 |
| 3,828,390 | 8/1974 | Cater | 15/321 |
| 3,871,051 | 3/1975 | Collier | 15/321 |
| 4,075,733 | 2/1978 | Parise et al. | 15/322 |
| 4,200,952 | 5/1980 | Smies et al. | 15/322 |

FOREIGN PATENT DOCUMENTS

| | | | |
|---|---|---|---|
| 892658 | 3/1962 | United Kingdom | 15/322 |

*Primary Examiner*—Chris K. Moore

[57] ABSTRACT

A combination vacuum and spray head for a pressurized cleaning apparatus adapted especially for use upon open grating. The structure includes a vacuum head housing, a shielded spray head that provides a plurality of downwardly, diagonally directed spray nozzles for directing a stream of fluid against the opposite sides of parallelly extending grate slats.

4 Claims, 3 Drawing Figures

VACUUM SPRAY HEAD

SUMMARY OF THE INVENTION

It is a principal object of this invention to provide a device that is instrumental in cleaning a grated surface in an efficient and economical manner.

Another object of this invention is to provide a combination vacuum recovery system with a pressurized fluid spray head, with each separate entity capable of performing its assigned task independently, or in cooperation with each other.

To achieve these objects the device provides a vacuum hood, that in turn partially encloses and supports a manifold of fluid spray nozzles, contained within a separate shield. The unit includes a supporting means in the form of elongated rollers adapted to span a plurality of grate slats whereby the complete unit may be moved over the grate to be cleaned.

Because grates are constructed in various sizes with different shaped slats, it is desirable to be able to modify the direction of the sprayed cleaning fluid onto the slats. To accomplish this, the manifold of spray nozzles as well as the shield is adjusted within the vacuum hood, changing their relation to the grate and the resulting spray pattern thereon.

Other objects will appear hereinafter.

BRIEF DESCRIPTION OF THE DRAWINGS

This invention will be best understood by reference to the accompanying drawings which show the preferred form of construction by which the stated objects are achieved and in which.

GENERAL DESCRIPTION

The combined vacuum-spray head of this invention is readily adaptable for use with a pressurized cleaning system that produces a recovery vacuum and a pressurized heated cleaning fluid source. Such a system is shown and described in a co-pending application Ser. No. 509,348 Filed June 30, 1983.

Figure 1:
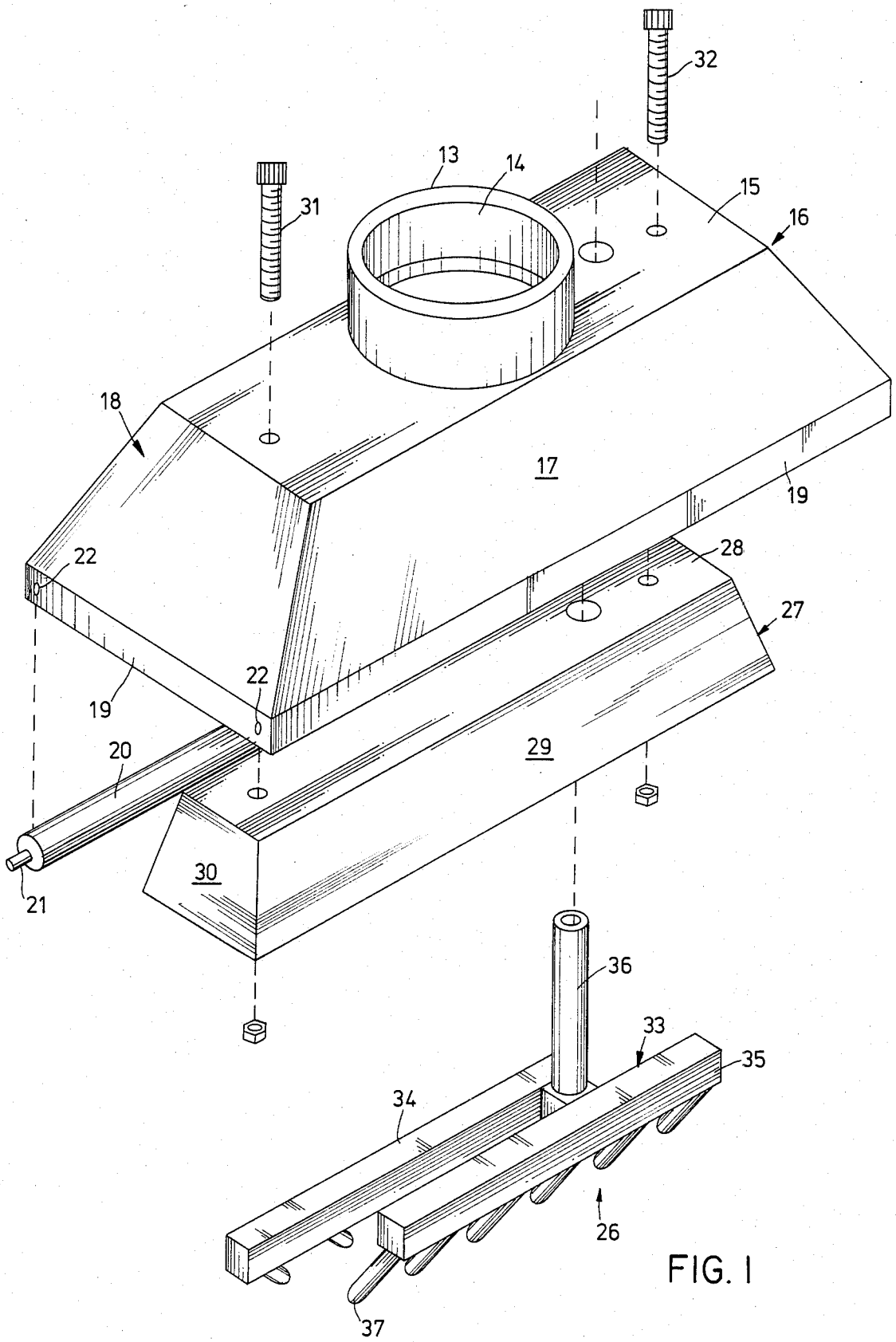
FIG. 1 is perspective view of the structural parts of this invention in an exploded relation.
Figure 2:
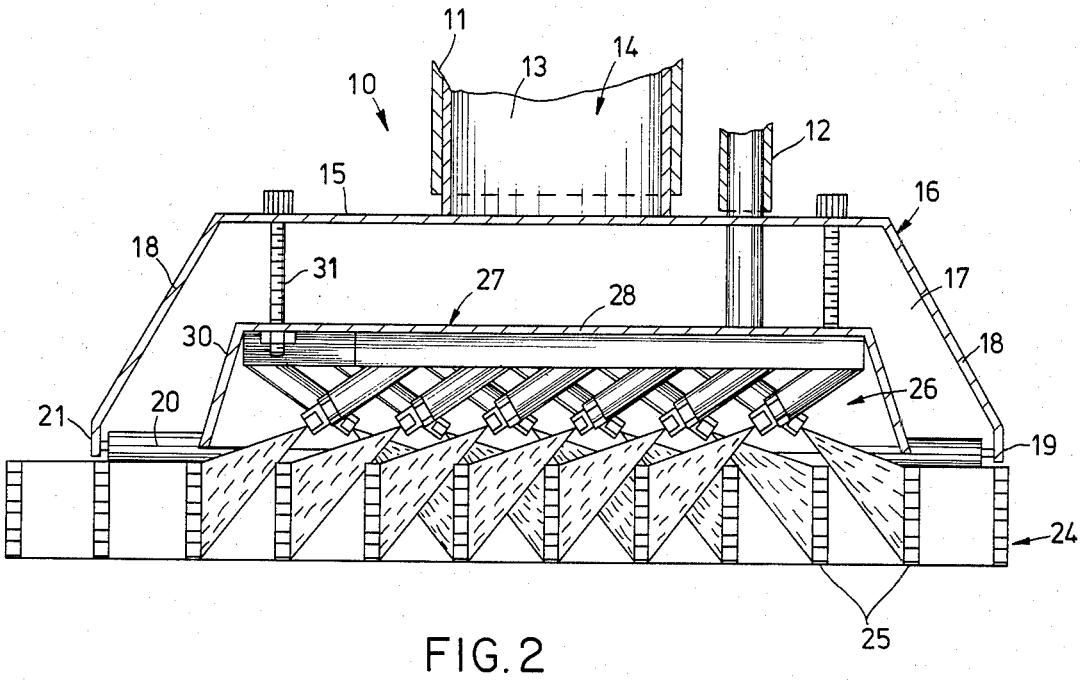
FIG. 2 is a side elevational view of the vacuum spray head of this invention in composite form.
Figure 3:
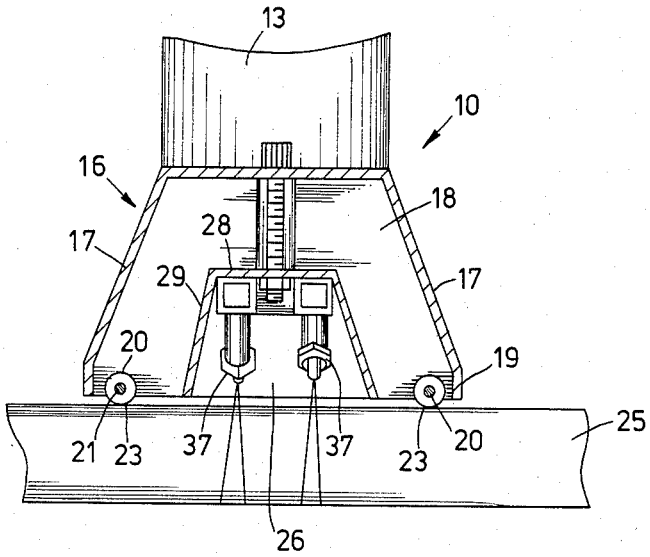
FIG. 3 is an end elevational view of the invention.

In the present invention the combined vacuum and spray unit is identified by numeral 10, FIGS. 2 and 3.

The unit 10 is illustrated as providing a connection with a vacuum hose 11, and a fluid supply line 12. This vacuum hose 11 is journaled upon a collar 13 that defines an inlet port 14 formed in the top wall 15 of a hood 16.

The hood 16 includes side walls 17 and end walls 18 all of which taper in a downwardly and outwardly direction from corresponding edges of the top wall 15. These side and end walls 17 and 18 terminate into a depending flange 19, which in turn defines the open bottom of the hood 16.

Within the hood 16 and extending in a parallel relation to the flange 19, depending from the side walls 17, are a pair of elongated rollers 20. Mounting pins 21 extend axially of the rollers 20, and are projected into receiving apertures 22 formed in the end flanges 19.

It should be noted that the rollers 20 are of sufficient diameter so as to a portion of their peripheral edges 23 projecting beneath the lowermost edge of the depending flange 19. Thus the rollers 20 will support the unit 10 above a grate 24 to be cleaned. Also, by reason of their length the rollers 20 will span a number of grate slats 25 so as to maintain the unit 10 on an even keel as it is moved over the entire surface of the grate 24 to be cleaned.

Contained within the hood 16, is the spray head 26. This head 26 includes a shield 27 having substantially the same configuration as the hood 16. That is to say that the shield 27 consists of a top wall 28, generally rectangularly shaped, with side walls 29, and end walls 30, tapered downwardly and outwardly as shown.

To contain the shield 27 within the hood 16, there is provided a pair of nuts and bolts, 31 and 32 respectfuly, extending between the top walls 15 and 28 of each part of the unit 10. By threadable adjustment of the nuts and bolts 31 and 32, the shield may be vertically adjusted within the hood 16. As the spray head 26 is elevated with respect to the rollers 20, the angle of incident of the fluid spray against the slats 25 of the grate 24 is varied. Thus by adjustment the field of spray can be directed over a greater area, and upon varying sized grates.

Embodied within the spray head 26, is the manifold distributor 33, consisting of a pair of elongated tubular members 34 and 35, each having open communication with an inlet tube 36, that as shown extends upwardly through the hood 16 and connects to the fluid supply line 12.

The underside of the tubular members 34 and 35 have formed therein a plurality of passages that have open communication with the adjustable nozzles 37. As clearly shown these nozzles are angular connected to the members 34 and 35, so as to direct a spray of fluid therefrom in a like direction. Each set of nozzles 37, on each of the members 34 and 35 are directed in opposite directions so that a field of spray may be directed against both sides of the slats 25 on the grate 24.

By this described arrangement the unit 10 can perform its function of cleaning and vacuum recovery relative to a grate surface. The oversized hood 16 creates a vacuum recovery area that surrounds the fluid spraying area, thus creating a full recovery of the cleaning fluid and any contamination removed thereby. The spray shield 27, with spray head 26 as it is adjusted through various elevations relative to the roller contact with the grate surface, will regulate its field of spray, to accommodate grates having different slat separation and depth.

While we have illustrated and described the preferred form of construction for carrying our invention into effect, this is capable of variation and modification without departing from the spirit of the invention. We, therefore, do not wish to be limited to the precise details of construction as set forth, but desire to avail ourselves of such variations and modifications as come within the scope of the appended claims.

Having thus described the invention, what we claim as new and desire to secure by Letters Patent is:

1. A vacuum spray head for a cleaning apparatus adapted to clean grate type surfaces with the apparatus having a heated cleaning fluid source and a vacuum recovery system, wherein the improvement comprises, (a) a hood having a top wall and side and end walls extending downwardly and outwardly therefrom and terminating in a depending peripheral flange, (b) a shield carried within and spaced from said hood, (c) means providing communication between the vacuum recovery system and the space between said hood and said shield, (d) elongated rollers of a length greater than said shield and carried by said peripheral flange of said end walls and extending in parallel relation to the side walls within said hood for rolling engagement with the parallel slats of a grate to be cleaned, (e) a fluid dispensing means within said shield extending parallel to said elongated rollers for dispensing cleaning fluid simultaneously in opposite parallel directions to said rollers onto the opposite sides of the slats of the grate to be cleaned, (f) means connecting said fluid dispensing means to the heated cleaning fluid source, and (g) means extending between said hood and said shield for adjustably positioning said shield and said fluid dispensing means within said hood in a direction perpendicular to said elongated rollers so as to vary the distance of said fluid dispensing means to the side of the slats of the grate to be cleaned.

2. A vacuum spray head for a cleaning apparatus as defined by claim 1, wherein said fluid dispensing means comprises a manifold including two sets of nozzles, with the nozzles of each set directed into opposite angular directions.

3. A vacuum spray head for a cleaning apparatus as defined by claim 1, wherein said shield is of a configuration like that of said hood, smaller in size so as to be contained within said peripheral flange such as to provide a surrounding vacuum recovery area adjacent to said fluid dispensing means.

4. A vacuum spray head for a cleaning apparatus as defined by claim 3, wherein said fluid dispensing means comprises a manifold including two sets of nozzles, with the nozzles of each set directed into opposite angular directions.

* * * * *